US006035669A

United States Patent [19]

Gutschmit

[11] Patent Number: 6,035,669

[45] Date of Patent: Mar. 14, 2000

[54] APPARATUS AND METHOD FOR DETECTING BROKEN HOOKS OF NEEDLES IN A KNITTING MACHINE

[75] Inventor: Alan Gutschmit, Troy, N.C.

[73] Assignee: Monarch Knitting Machinery Corp., Glendale, N.Y.

[21] Appl. No.: 09/322,873

[22] Filed: May 28, 1999

[51] Int. Cl.[7] ..... D04B 35/10

[52] U.S. Cl. ..... 66/157; 66/165

[58] Field of Search ..... 66/157, 161, 163, 66/164, 165, 162, 166

[56] References Cited

U.S. PATENT DOCUMENTS

| | | | |
|---|---|---|---|
| 3,646,542 | 2/1972 | Anthony | 66/157 |
| 3,659,437 | 5/1972 | McArthur et al. . | |
| 3,785,177 | 1/1974 | Hino et al. . | |
| 3,904,529 | 9/1975 | Nakamura . | |
| 3,905,211 | 9/1975 | Raisin et al. . | |
| 3,910,074 | 10/1975 | Parker . | |
| 3,937,038 | 2/1976 | Sick . | |
| 3,946,578 | 3/1976 | Venczel . | |
| 3,987,649 | 10/1976 | Parker . | |
| 4,026,128 | 5/1977 | Blanco . | |
| 4,027,982 | 6/1977 | Ohishi . | |
| 4,270,369 | 6/1981 | Quay et al. . | |
| 4,366,681 | 1/1983 | Homocky et al. . | |
| 5,524,460 | 6/1996 | Michetti et al. . | |

FOREIGN PATENT DOCUMENTS

| | | | |
|---|---|---|---|
| 2019447 | 10/1979 | United Kingdom | 66/157 |

*Primary Examiner*—Danny Worrell
*Attorney, Agent, or Firm*—Alston & Bird LLP

[57] ABSTRACT

Apparatus for detecting broken hooks of needles in a knitting machine having first and second cam faces defining a cam for slidably receiving needle butts. The cam includes a raising cam portion, a stitch cam portion, and a gate cam portion in which tension forces between yarn loops and hooks bias the butts of intact needles against the first cam face. The detector has a detector butt raising segment wherein the second cam face in the gate cam portion is inclined away from the second cam face at the stitch position for urging butts toward the first cam face. A detector butt lowering segment follows the detector butt raising segment, in which the first cam face urges the butts toward the second cam face. A recess segment follows the butt lowering segment. The recess is formed so that the second cam face is sufficiently spaced from the first cam face so that butts of needles having broken hooks are urged into the recess segment by the detector butt lowering segment but butts of intact needles that are biased against the first cam face do not enter the detector recess segment. A sensor identifies butts of broken needles in the detector recess segment. The apparatus may further include means for stopping operation of the knitting machine when the sensor is activated. A method for detecting broken hooks is also provided.

6 Claims, 2 Drawing Sheets

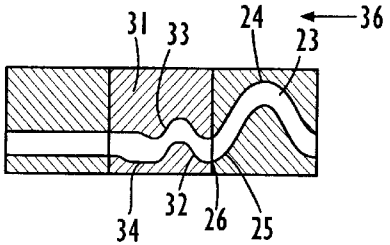
FIG. 4.
FIG. 1.
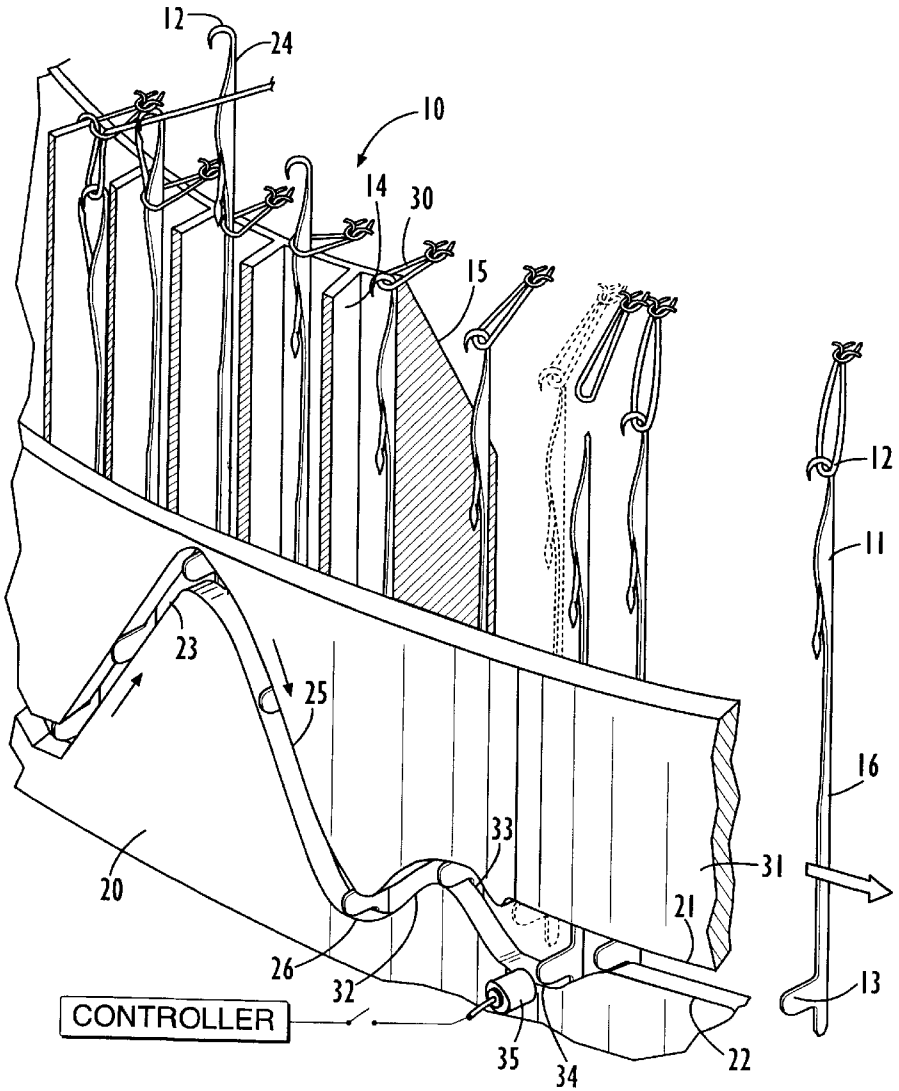

APPARATUS AND METHOD FOR DETECTING BROKEN HOOKS OF NEEDLES IN A KNITTING MACHINE

FIELD OF THE INVENTION

The present invention relates to knitting machines, and in particular to circular knitting machines of the type that utilize latch needles. More particularly, the invention relates to a system for detecting when hooks on needles in the machine are broken or are otherwise non-functional, and for stopping operation of the machine to prevent fabric defects.

BACKGROUND OF THE INVENTION

In the operation of knitting machines, needles having hooks at one end are moved in reciprocating fashion to engage yarns and to pull them into loops or various structures so as to form a knitted fabric. In general, knitting machines may be classified into two types: flat bed knitting machines and circular knitting machines. In both types of machines, means is provided for urging the needles into reciprocating motion. For example, in many knitting machines the needles are provided with one or more butts that extend from the side of a medial portion of the needle shaft. This butt fits into a cam that has upper and lower faces defining a generally undulating cam track. The cam moves laterally relative to the needles, thus urging the butts to follow the cam track and thereby causing the needles to move in translation due to displacement of the cam track.

As the needles move in translation, the hooks on the ends thereof engage yarns and manipulate the yarns to form a knitted fabric. If the hook on the end of a latch needle is broken or if it fails to engage a yarn, the latch needle can no longer perform the function of forming a loop. If a broken hook is undetected, the circular knitting machine will continue to operate, but the broken hook will cause a continuing defect in the knitted fabric. These defects are unacceptable in the knitted product and therefore result in loss of salable knitted fabric. It is therefore desirable to provide a system for detecting when a needle hook is broken or otherwise nonfunctional and to stop operation of the circular knitting machine soon after the broken hook is detected so that the broken needle may be replaced.

Apparatus and methods for detecting and reducing fabric defects for use with circular knitting machines are known. For example, U.S. Pat. No. 3,785,177 (the "Hino patent") shows a device for sensing a broken yarn of a circular knitting machine. As an initial matter, the invention in the Hino patent is addressed to broken yarns, and not to broken hooks. Detecting broken yarns is particularly important in knitting machines for producing underwear and undergarments. In the Hino patent, the sensor and associated cam structure are positioned at the base of a stitch cam. Importantly, positioning of the sensor at the base of a stitch cam requires some spacing in the cam for the free deflection of needles with broken hooks or yarns. Placing the sensor at the bottom of the stitch cam, with the corresponding free space required, is impractical in modern high-speed knitting machines, which require very accurate and precise control of the needle butt during the stitch-forming process.

Other references show various apparatus and methods for detecting broken hooks in latch needles in knitting machines. Many of the references focus their detecting devices at or near the hook portion of the needle rather than at the butt portion of the needle. For example, U.S. Pat. No. 3,659,437, MacArthur et al., shows a defective needle detector that uses a beam of collimated energy directed to the hook end of the needles to detect the presence or absence of hooks. Alternatively, a magnet with a piece of electrical crystal may be mounted in the proximity of the needle hooks.

U.S. Pat. No. 3,904,529, Nakamura, shows an apparatus for detecting defective needles which uses an optical fiber having an end disposed so as to detect light reflections from hooks or latch portions of needles in a similar manner to MacArthur et al.

U.S. Pat. No. 3,905,211, Raisin, et al., shows another detector apparatus using magnetic detectors on a hosiery loom. This system employs a magnetic detector mounted to the outside of the loom, and the detector analyzes the entire needle rather than focusing on the needle hook. These and other attempts to detect broken needles and to stop operation of the machine fail to show or suggest the precepts of the present invention, particularly since they show detectors located at or near the needle hook as opposed to detectors in the cam track near the butt of the needles. Moreover, the prior art systems are more complicated and prone to malfunction. None of the systems provides for high speed operation while simultaneously maintaining precise accurate control of needles as they pass through the stitch cam.

In view of the foregoing, it is an objective of the invention to provide a simple and inexpensive improved apparatus and method for detecting broken hooks which allows for accurate control of the needle position at the stitch cam.

SUMMARY OF THE INVENTION

Apparatus is provided for detecting broken hooks of needles in a knitting machine having first and second cam faces defining a cam for slidably receiving needle butts. The cam includes a raising cam portion for moving the needles to a raised position for receiving yarns, a stitch cam portion following the raising cam portion for moving the needles to a stitch position for making yarn loops, and a gate cam portion following the stitch cam portion in which tension forces between the yarn loops and needle hooks bias the butts of intact needles against the first cam face. The detector apparatus has a detector butt raising segment in the gate cam portion wherein the second cam face in the gate cam portion is inclined away from the second cam face at the stitch position for contacting butts and urging the butts toward the first cam face. A detector butt lowering segment is located in the gate cam portion following the detector butt raising segment, wherein the first cam face contacts the needle butts and urges the butts toward the second cam face. A detector recess segment in the gate cam portion follows the detector butt lowering segment, so that the second cam face is sufficiently spaced from the first cam face so that butts of needles having broken hooks are urged into the recess segment by the detector butt lowering segment but butts of intact needles that are biased against the first cam face do not enter the detector recess segment. A sensor is provided in the detector recess segment for identifying the presence of needle butts in the detector recess segment. The apparatus may further include means for stopping operation of the knitting machine when the sensor detects a butt in the detector recess segment. The sensor may be a blade that projects into the cam track and which is activated by contact with a needle butt. The sensor may include an electrical switch that is tripped by movement of the blade.

Also provided is a method for identifying broken hooks of needles in a knitting machine. The method includes providing a gate cam having first and second cam faces for controlling the position of needles in a knitting machine so that intact needles are biased against the first cam face by tension forces between the needle hooks and yarns; contacting the needle butts with an inclined portion of the second cam face to urge the butts toward the first cam face; contacting the needle butts with a declined portion of the first cam face to urge the butts toward the second cam face; providing a detector recess segment in which the second cam face is sufficiently spaced from the first cam face so that butts of needles having broken hooks enter the recess due to contact with the declined portion of the first cam face; sensing the presence of butts in the detector recess segment with a sensor; and stopping operation of the knitting machine when the sensor is actuated.

BRIEF DESCRIPTION OF THE DRAWINGS

The above objects and other features and advantages of the present invention will become apparent from the following description taken in conjunction with the accompanying drawings, in which:

FIG. 1 is an environmental perspective view showing one embodiment of the invention incorporated in the cylinder cam of a circular knitting machine;

FIG. 4 is a schematic elevation view of stitch cam and a gate cam in accordance with the present invention.

DETAILED DESCRIPTION OF THE INVENTION

Figure 2:
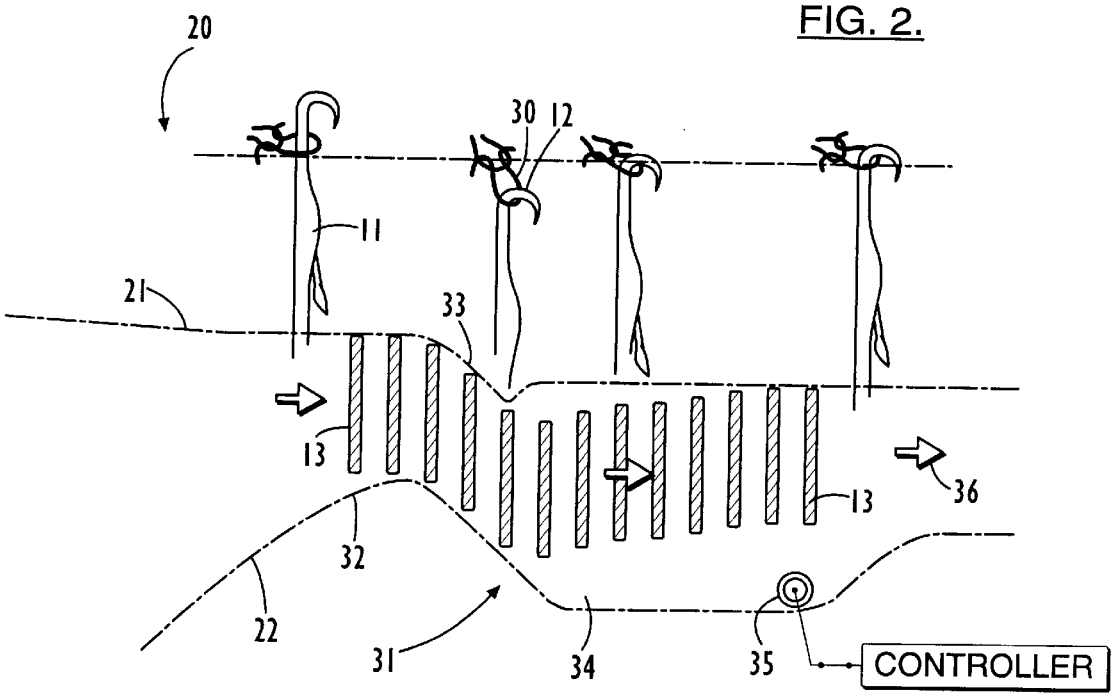
FIG. 2 is a partially schematic side elevation detail view of one embodiment of the invention, illustrating the motion of intact needles through the cam.

The present invention now will be described more fully hereinafter with reference to the accompanying drawings, in which a preferred embodiment of the invention is shown. This invention may, however, be embodied in many different forms and should not be construed as limited to the embodiment set forth herein; rather, the embodiment is provided so that this disclosure will be thorough and complete, and will fully convey the scope of the invention to those skilled in the art. Like numbers refer to like elements throughout.

Referring now to FIG. 1, designated generally as 10 is a section of the cylinder 15 and cylinder cam 20 of a circular knitting machine. Needles 11 having hooks 12 and butts 13 are positioned in tracks 14 of the knitting machine cylinder 15 so as to be arranged for translational motion in the direction of the needle shaft 16. The cam 20 is provided around the outer periphery of the cylinder 15. First and second faces 21 and 22 of the cam 20 (shown herein as upper and lower faces, respectively) define a track of the cam 20 through which the needle butts 13 are slidably received. The cam 20 and cylinder 10 move rotationally past each other so that the butts 13 are forced up and down due to displacement of the track defined by the faces 21 and 22 of the cam 20.

The cam 20 includes a needle raising portion 23, which as shown in FIG. 1 raises the needles to a raised position 24. When the needles are in the raised position, the hooks 12 thereof may receive a new yarn to be knitted. Following the raising cam portion 23 in the cam 20 is a stitch cam portion 25. The stitch cam portion 25 moves the needles downwardly, away from the needle raising position 24, and ultimately to a stitch position 26. When the needles 11 are in the stitch position, the hooks engage loops 30 of the knitted fabric being formed by the machine. Tension in the knitted loops 30 tends to pull the needles upwardly against the upper or first cam face 21 when the needles are in or near the stitched position 26.

A gate cam portion 31 of the cam 20 follows the raising portion 23 and the stitch portion 25 (note that the needles move through the cam track in the direction of the arrows on FIG. 1. The position of the track defined by the upper and lower faces 21 and 22 of the gate cam portion 31 is such that the butts 13 of intact needles 11 are biased against the upper or first face 21 by tension between the hooks 12 and yarn loops 30. In the gate cam portion, a detector butt raising segment 32 is provided following the stitch position 26 formed by the stitch cam 25. This detector butt raising segment in the gate cam portion 31 is inclined away from the second cam face 22 at the stitch position 26. The detector butt raising segment 32 contacts the butts 13 of the needles and urges them upwardly, in the direction of the first cam face 21. This portion provides for accurate control of the needle butts 13 as they leave the stitch position 26.

Following the detector butt raising segment 32 is a detector butt lowering segment 33, which is formed in the upper or first face 21 of the cam 20. The detector butt lowering segment 33 contacts the butts 13 as they move past the butt raising segment 32 and urges the butts downwardly again in the direction of the second or lower cam face 22.

Partially underlying and following the detector butt lowering segment 33 is a detector recess segment 34. The detector recess segment 34 is formed in the lower or second cam face 22 in the gate cam portion 31. In the recess segment 34, the second or lower cam face 22 is sufficiently spaced away from the upper or first cam face 21 so that butts of defective needles may be identified by the their motion which is distinct from the motion of intact needles 11 by means of the sensor 35, which is positioned in the detector recess segment 34. The sensor 35 identifies the presence of needle butts in the detector recess segment 34.

Figure 3:
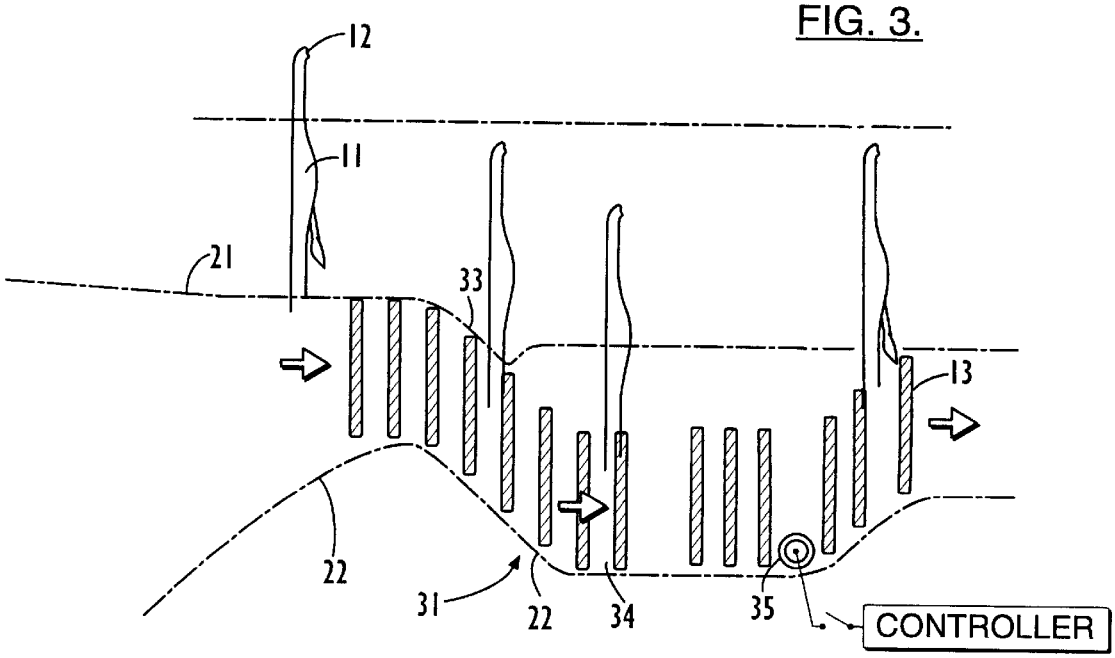
FIG. 3 is a partially schematic side elevation detail view of one embodiment of the invention in which the motion of defective hooks through the cam track is shown.

Referring now to FIG. 3, one portion of the invention is shown in a partially schematic view which shows a plurality of needles 11, cross sections of needle butts 13, and the first and second cam faces 21 and 22 within the gate cam portion 31 of the cam 20. The direction of motion of the butts through the gate cam 31 is indicated by arrows 36. As indicated in this illustration, the detector butt raising portion 32 ensures that the butts 13 are positioned adjacent the upper or first face 21 as the needles move towards the detector butt lowering segment 33. Upon encountering the detector butt lowering segment 33, the butts are urged downwardly, in the direction of the second or lower face 22. At this point, tension forces between the hooks 12 of the needles and knitted yarn loops 30 tend to pull the needles upwardly, thus biasing them against the first cam face 21. Thus, as shown in FIG. 2, as the butts 13 move past the detector butt lowering segment 33 they are pulled upwardly by these tension forces so as to move once again into contact with the first or upper cam face 21. As shown in FIG. 2, it is possible that immediately after leaving the detector butt lowering segment 33, the butts 13 may not remain in contact with the upper face 21; however, in this event the butts are sufficiently restrained by the tension forces between the hooks 12 and yarn loops 30 that they do not enter the detector recess segment 34, and they soon rejoin contact with the first face 21. Thus, the needle butts do not actuate the sensor 35 in the recessed segment 34.

The motion of the butts 13 of needles 11 having broken hooks 12 is illustrated in FIG. 3. In this view, the butts 13 initially pass by the detector butt raising segment 32 and may be engaged by that segment to ensure that the butts 13 are in contact with the upper face 21 of the gate cam portion 31. The butts 13 next encounter the detector butt lowering segment 33, which urges the butts downwardly, in the direction of the second or lower face 22. However, due to the broken hooks 12, there are no tension forces between any portion of the needle and the knitted yarn loops 30 or fabric which tend to pull the needle upwardly. Thus, the needle butts 13 are urged by the detector butt lowering segment 33 into the detector recess segment 34. As the needle butts 13 continue on their path through the recess segment 34, the sensor 35 detects their presence in the recess 34.

Referring now to FIGS. 2 and 3 collectively, it is seen that actuation of the sensor by the presence of needle butts 13 within the detector recess 34 actuates a controller. The controller may be an output for giving an operator an indication of a fabric and/or needle defect. Alternatively, the controller may automatically stop operation of the knitting machine so that the defect may be corrected, such as by removing the needle having a broken hook 12 and replacing it with a new needle.

FIG. 4 shows an elevation view of a needle raising and stitch cam portions 23, 25, and a gate cam portion 31. As indicated therein, the needles moving in the direction 36 move past the raising cam portion 23 to a raised position 24, and thereafter into the stitch cam portion 25 to the stitch position 26. Thereafter, the needles move into the gate cam portion 31, and in the gate cam encounter the butt raising segment 32, butt lowering segment 33 and recess segment 34.

Again referring to FIGS. 1, 2 and 3, the sensor 35 may be a blade that projects into the cam track in the detector recess segment 34. When this blade is contacted by needle butts 13, it may actuate a switch that controls an electrical circuit tied to the driving means for the knitting machine 10. Alternatively, any of a variety of other sensor means may be used, as desired, for identify the presence of needle butts with the recessed segment 34. For example, it is envisioned that an electrical contact, laser or photoelectric sensor means might be provided to identified butts 13 that pass through the recess segment 34. Other various will be seen by persons of ordinary skill in the art and are encompassed by the scope of this invention.

Referring again to FIG. 1, a method for identifying broken hooks of needles in a knitting machine is also provided. The method includes providing a gate cam portion 31 having first and second cam faces 21 and 22 for controlling the position of needles 11 in a knitting machine 10 so that intact needles are biased against the first cam face 21 within the gate cam portion 31 by tension forces between the needle hooks 13 and knitted fabric or yarns 30. The needle butts 13 in the gate cam portion 31 are contacted first by an inclined portion 32 of the second cam face 22 in the gate cam portion 31 (i.e., the detector butt raising segment 32) to urge the butts 13 towards the first cam face 21. Next, the needle butts 13 are contacted by the declining, or detector butt lowering segment 33, of the first cam face 21 to urge the butts 13 towards the second cam face 22. Next, the butts 13 are moved past a detector recess segment 34 that is provided for identifying the presence of defective needles. Contact between the declining or butt lowering segment 33 causes the needle butts 13 to move in the direction of the recessed segment 34; however, only butts of needles 11 with broken or otherwise nonfunctioning hooks 12 enter the recessed segment 34. The next step is sensing the presence of butts 13 in the detector recess segment 34 by the use of a sensor 35, as described above. The method also includes stopping operation of the knitting machine when the sensor is actuated.

The inventive apparatus and method may be used in connection with dial cams (not shown) as well as with cylinder cams as illustrated and described in particular above.

If preferred, only one detector portion and sensor may be provided in a track of a knitting machine, as all of the butts in that cam will pass the detector and sensor during each rotation of the machine. For example, a particular cam track may have multiple raising cam portions and stitch cam portions but only one detector portion. Alternatively, multiple detector portions/sensors may be provided.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiment disclosed and that modifications and other embodiments are intended to be included within the scope of the appended claims. Although specific terms are employed herein, they are used in a generic and descriptive sense only and not for purposes of limitation.

That which is claimed:

1. Apparatus for detecting broken hooks of needles in a knitting machine having first and second cam faces defining a cam for slidably receiving needle butts, the cam including a raising cam portion for moving the needles to a raised position for receiving yarns, a stitch cam portion following the raising cam portion for moving the needles to a stitch position for making yarn loops, and a gate cam portion following the stitch cam portion in which tension forces between the yarn loops and needle hooks bias the butts of intact needles against the first cam face, the apparatus comprising:

a detector butt raising segment in the gate cam portion, wherein the second cam face in the gate cam portion is inclined away from the second cam face at the stitch position for contacting butts and urging the butts toward the first cam face;

a detector butt lowering segment in the gate cam portion following the detector butt raising segment, wherein the first cam face contacts the needle butts and urges the butts toward the second cam face;

a detector recess segment in the gate cam portion following the detector butt lowering segment, wherein the second cam face is sufficiently spaced from the first cam face so that butts of needles having broken hooks are urged into the recess segment by the detector butt lowering segment but butts of intact needles that are biased against the first cam face do not enter the detector recess segment; and a sensor in the detector recess segment for identifying the presence of needle butts in the detector recess segment.

2. Apparatus as defined in claim 1 further comprising means for stopping operation of the knitting machine when said sensor detects a butt in the detector recess segment.

3. Apparatus as defined in claim 1 wherein said sensor is a blade that projects into the cam track and which is activated by contact with a needle butt.

4. Apparatus as defined in claim 3 wherein said sensor is an electrical switch that is tripped by movement of the blade.

5. A gate cam for controlling butts of needles in a knitting machine, comprising:

first and second cam faces defining a cam track;

a detector butt raising segment wherein the second cam face is inclined toward the first cam face for contacting butts and urging the butts toward the first cam face;

a detector butt lowering segment following the detector butt raising segment, wherein the first cam face contacts the needle butts and urges the butts toward the second cam face;

a detector recess segment following the detector butt lowering segment, wherein the second cam face is sufficiently spaced from the first cam face so that butts of needles having broken hooks are urged into the recess segment by the detector butt lowering segment; and a sensor in the detector recess segment for identifying the presence of needle butts in the detector recess segment.

6. A method for identifying broken hooks of needles in a knitting machine, the method comprising:

providing a gate cam having first and second cam faces for controlling the position of needles in a knitting machine so that intact needles are biased against the first cam face by tension forces between the needle hooks and yarns;

contacting the needle butts with an inclined portion of the second cam face to urge the butts toward the first cam face;

contacting the needle butts with a declined portion of the first cam face to urge the butts toward the second cam face;

providing a detector recess segment in which the second cam face is sufficiently spaced from the first cam face so that butts of needles having broken hooks enter the recess due to contact with the declined portion of the first cam face;

sensing the presence of butts in the detector recess segment with a sensor; and stopping operation of the knitting machine when the sensor is actuated.

* * * * *